US005511378A

United States Patent [19]

Lindlbauer et al.

[11] Patent Number: 5,511,378

[45] Date of Patent: Apr. 30, 1996

[54] MODULATING AIR/FUEL RATIO

[75] Inventors: Michael P. Lindlbauer, Canton; Terry W. Childress, Clinton Township, both of Mich.

[73] Assignee: Ford Motor Company, Dearborn, Mich.

[21] Appl. No.: 435,302

[22] Filed: May 5, 1995

[51] Int. Cl.[6] ..... F01N 3/20

[52] U.S. Cl. ..... 60/274; 60/285

[58] Field of Search ..... 60/274, 285

[56] References Cited

U.S. PATENT DOCUMENTS 4,617,794 10/1986 Fujitani ..... 60/274

5,052,177 10/1991 Nada ..... 60/274

5,209,060 5/1993 Hirschmann et al. ..... 60/285

5,363,648 11/1994 Akazaki et al. ..... 60/285

OTHER PUBLICATIONS

"Performance and Durability of Palladium Only Metallic Three–Way Catalyst", M. Harkonen, M. Kivioja, P. Lippi, P. Mannila, T. Maunuia and T. Slotte.

*Primary Examiner*—Leonard E. Reyman

*Attorney, Agent, or Firm*—Peter Abolins; R. L. May

[57] ABSTRACT

The amplitude of peak to peak air to fuel ratio variation of an internal combustion engine is modulated as a function of catalyst temperature.

4 Claims, 2 Drawing Sheets

IMPUT: CATALYST TEMPERATURE
OUTPUT: ISC_PTP_MULT

INPUT: CATALYST TEMPERATURE, LOAD
OUTPUT: PTP_MULT

MODULATING AIR/FUEL RATIO

BACKGROUND OF THE INVENTION

1. Field of the Invention

This invention relates to electronic engine control of internal combustion engine operation.

2. Prior Art

Prior technology modulates air to fuel ratio peak to peak amplitude as a function of engine rpm and mass air flow only. It would be desirable to control air to fuel ratio so as to improve engine and catalyst operation.

SAE paper 940935 entitled "Performance and Durability of Palladium Only Metallic Three-Way Catalyst" by Matti Harkonen, Matti Kivioja, Pekka Lappi, Paivi Mannila, Teuvo Maunula and Thomas Slotte teaches that adjusting the air-to-fuel ratio can lower catalyst light-off temperatures.

SUMMARY OF THE INVENTION

In accordance with an embodiment of this invention the peak to peak amplitude of the engine air to fuel ratio is modulated as a function of catalyst temperature. Vehicle data has indicated that the conversion efficiency of the catalyst changes for different air to fuel ratio peak to peak amplitudes. If the peak to peak amplitude is too high, the driveability of the vehicle will suffer due to engine rpm surges. If the peak to peak amplitude is too low, the emissions may be unfavorably altered. Making the peak to peak amplitude a function of catalyst temperature as well as a function of rpm and load improves catalyst operation and lowers tail pipe emissions.

This invention further includes using a different air to fuel ratio peak to peak amplitude multiplier when the engine is at idle as opposed to when it is running in gear at part throttle or full throttle. When the engine is at idle, the engine rpm is more likely to roll (i.e. vary in magnitude). This is due to the low torque supplied at idle as opposed to the high torque supplied when the engine is in gear. Power drain, such as the air conditioning unit, is much more noticeable at low torque. The separate multiplier for the peak to peak amplitude at idle corrects for the likelihood of rpm roll.

DETAILED DESCRIPTION OF THE DISCLOSURE

Figure 1:
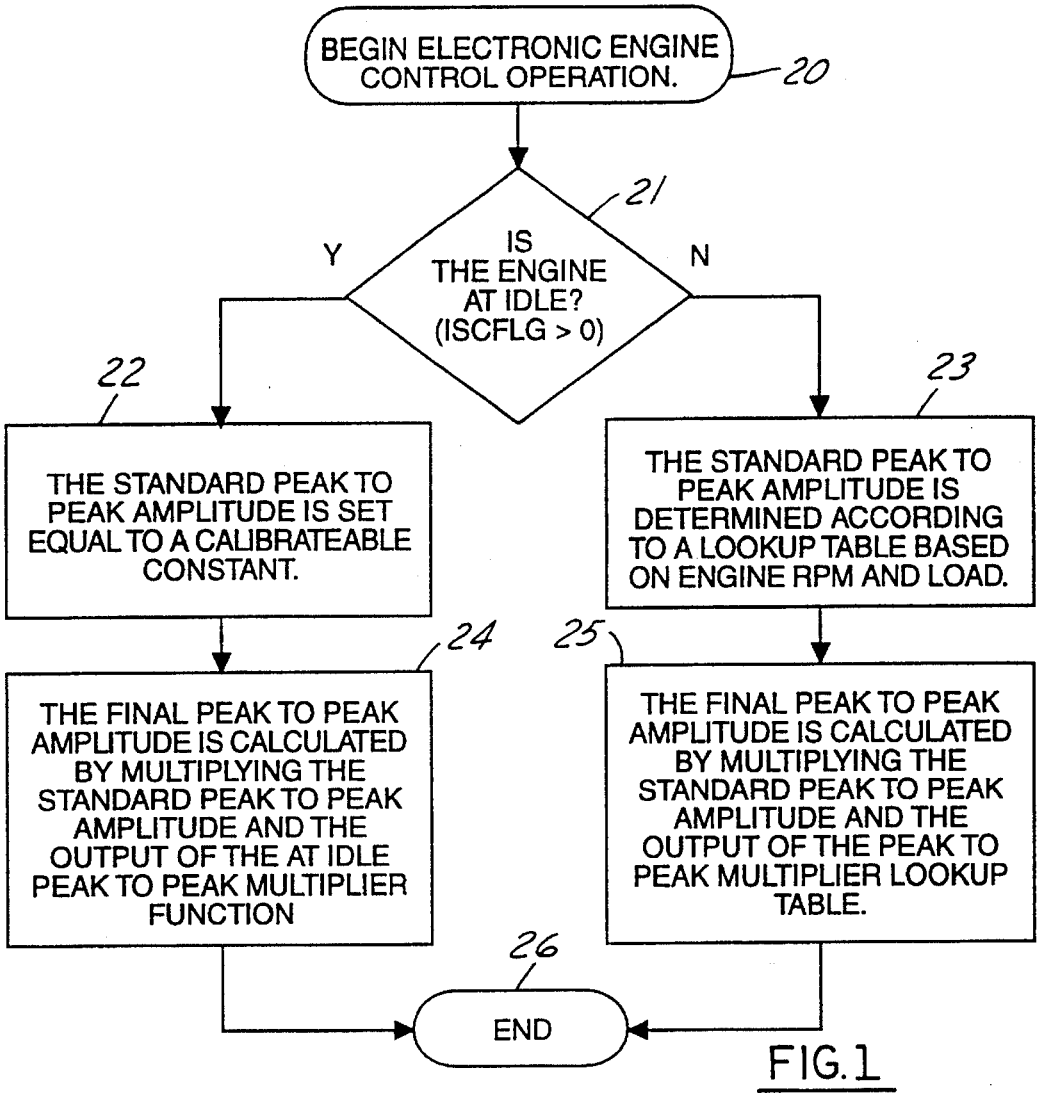
FIG. 1 is a logic flow chart in accordance with an embodiment of this invention.

The air fuel ratio applied to an internal combustion engine is modulated to improve the operation of a catalyst receiving exhaust gas from the engine. Referring to FIG. 1, logic flow starts at a block 20 where electronic engine control operation begins. Logic flow then goes to a block 21 to determine whether the engine is at idle. If a flag, ISCFLG, is greater than 0, the engine is not at idle, and logic flow goes to a block 23 wherein a standard peak to peak amplitude is determined according to standard a look up table which is based on engine RPM and load.

From block 23 logic flow goes to a block 25 where a final peak to peak amplitude is calculated by multiplying the standard peak to peak amplitude by the output of a peak to peak multiplier lookup table which is based on the temperature of the catalyst and load. Load is the instantaneous airflow that is moving through the engine divided by the maximum airflow that could be moving through the engine. From block 25, the process ends at a block 26.

If, at block 21, ISCFLG is not greater than 0, the engine is at idle, and logic flow goes to a block 22 wherein the standard air fuel peak to peak amplitude is set equal to a calibrateable constant that has been determined to be the most efficient peak to peak amplitude at idle.

From block 22 logic flow goes to a block 24 where a final peak to peak amplitude is calculated by multiplying the standard peak to peak amplitude by the output of an at idle peak to peak multiplier function that is based on catalyst temperature. From block 24, the process ends at block 26.

Figure 2:
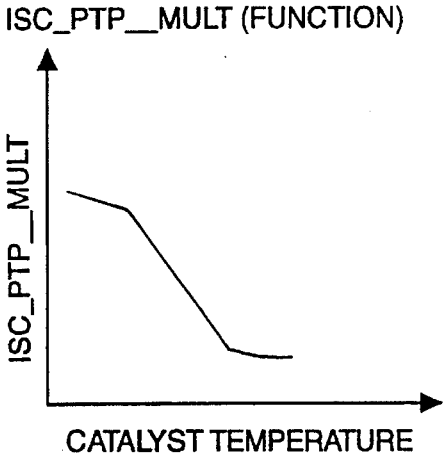
FIG. 2 is a graphical representation of an idle speed control air fuel ratio peak to peak amplitude multiplier function versus catalyst temperature.

FIG. 2 is a graphical representation of the idle air to fuel ratio peak to peak multiplier function. Catalyst temperature is the input and the idle air to fuel ratio peak to peak multiplier is the output.

Figure 3:
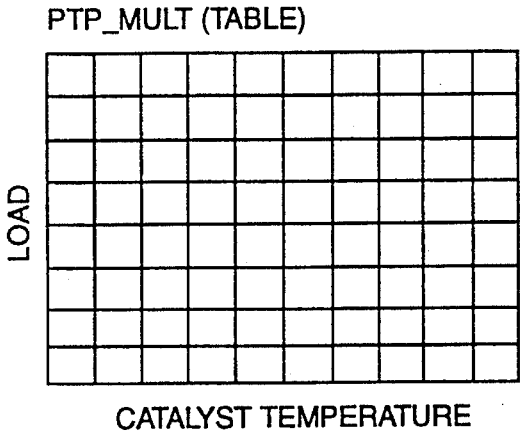
FIG. 3 is a table having catalyst temperature and load as inputs and air fuel peak to peak amplitude multiplier as an output.

Referring to FIG. 3, a table shows non-idle peak to peak air to fuel ratio multiplier values for inputs of catalyst temperature and engine load (i.e. mass air flow).

Figure 4A:
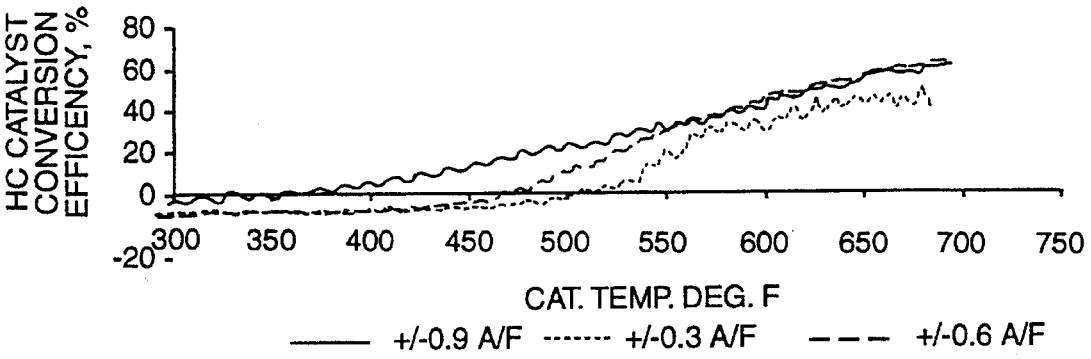
FIGS. 4A, 4B, and 4C are graphical representations of HC, CO, NOx conversion percentages with respect to catalyst temperature, respectively.
Figure 4B:
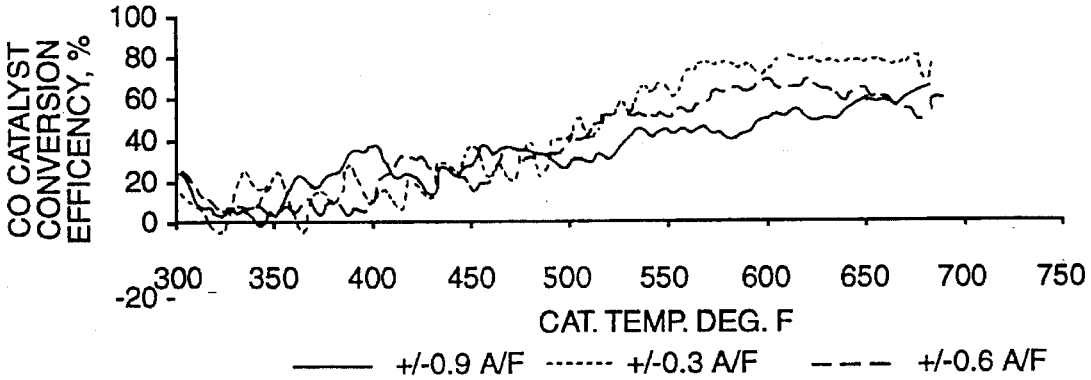
Figure 4C:
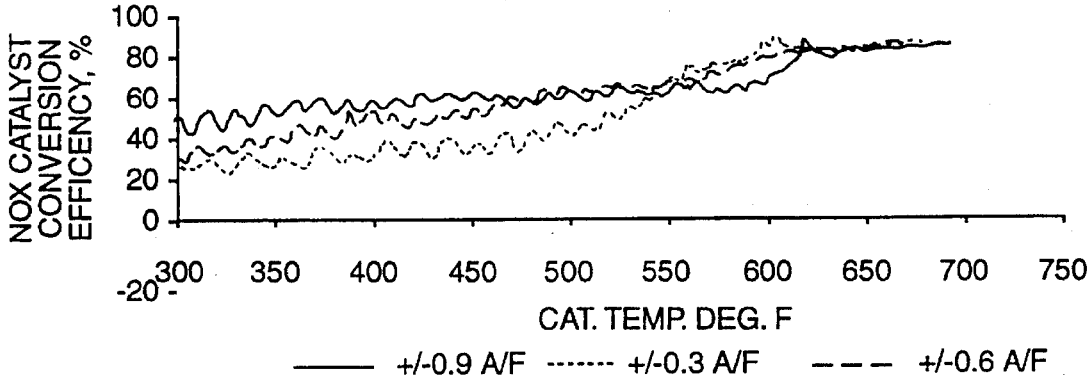

FIGS. 4A, 4B, and 4C, are graphical representations of catalyst conversion efficiencies versus catalyst temperature, for HC, CO, and NOx, respectively, at each of three different peak to peak air to fuel ratios. The plots indicate the catalyst converter efficiencies are dependent on the size of the air to fuel ratio peak to peak amplitudes. The catalyst converter dependency on peak to peak amplitude is primarily in the catalyst temperature range of 400–700 degrees Fahrenheit.

Air to fuel ratio is often desired to be held at a stoichiometric ratio of 14.7. FIGS. 4A, 4B, and 4C show data at three different air to fuel ratio peak to peak amplitudes: ±0.9 A/F; ±0.3 A/F; and ±0.6 A/F. For example ±0.9 A/F indicates an actual A/F ratio varying from 15.6 (i.e. 14.7+0.9) to 13.8 (i.e. 14.7–0.9). Air to fuel ratio may also be presented in a normalized manner wherein 1 would indicate air to fuel ratio at stoichiometry. An air fuel ratio of 15.6 would be represented in a normalized fashion by 1.06 (i.e. 15.6 divided by 14.7).

If desired this method can be applied to each bank of a V-type engine so that each bank can have independent peak to peak air to fuel ratio amplitude variation.

Various modifications and variations will no doubt occur to those skilled in the arts to which this invention pertains. Such variations which basically rely on the teachings through which this disclosure has advanced the art are properly considered within the scope of this invention.

We claim:

1. A method of controlling air to fuel ratio peak to peak amplitude in operation of an internal combustion engine having a catalyst including the steps of:

determining whether the engine is at idle;

if yes, setting a standard peak to peak amplitude equal to an idle calibrateable constant multiplied by a first function of catalyst temperature; and if no, setting the standard peak to peak amplitude equal to a non-idle calibrateable constant multiplied by a second function of catalyst temperature.

2. A method as recited in claim 1 wherein said first function of catalyst temperature is an idle speed control peak to peak multiplier determined as a function of catalyst temperature.

3. A method as recited in claim 2 wherein said second function of catalyst temperature is a peak to peak multiplier determined by the output of a lookup table which is based on inputs of catalyst temperature versus engine load.

4. A method of controlling air to fuel ratio peak to peak amplitude in operation of an internal combustion engine producing exhaust gas which is passed through a catalyst, by modulating the peak to peak air to fuel ratio amplitude as a function of engine rpm and load, and further:

modulating the peak to peak air to fuel ratio amplitude as a function of catalyst temperature including the steps of:

determining whether the engine is at idle;

if yes, setting a standard peak to peak air to fuel ratio amplitude equal to an idle calibrateable constant multiplied by a first function of catalyst temperature, said first function of catalyst temperature being an idle speed control peak to peak air to fuel multiplier determined as a function of catalyst temperature, thereby reducing variation in engine rpm and improving efficiency of operation of the catalyst; and if no, setting the standard peak to peak air to fuel ratio amplitude equal to a non-idle calibrateable constant multiplied by a second function of catalyst temperature, said second function of catalyst temperature being a peak to peak air to fuel ratio multiplier determined by the output of a lookup table which is based on inputs of catalyst temperature versus engine load, thereby improving efficiency of operation of the catalyst.

* * * * *